US005518073A

United States Patent [19]

Manke et al.

[11] Patent Number: 5,518,073

[45] Date of Patent: May 21, 1996

[54] MECHANICAL LOCKOUT FOR PRESSURE RESPONSIVE DOWNHOLE TOOL

[75] Inventors: Kevin R. Manke, Flower Mound; Paul Ringgenberg, Carrollton, both of Tex.

[73] Assignee: Halliburton Company, Dallas, Tex.

[21] Appl. No.: 481,558

[22] Filed: Jun. 7, 1995

Related U.S. Application Data

[62] Division of Ser. No. 238,417, May 5, 1994.

[51] Int. Cl.[6] ..... E21B 34/14; E21B 34/10

[52] U.S. Cl. ..... 166/240; 166/321; 166/332.3; 166/323

[58] Field of Search ..... 166/240, 237, 166/334, 332, 324, 332.3, 323; 74/88, 89

[56] References Cited

U.S. PATENT DOCUMENTS

| | | | |
|---|---|---|---|
| 3,703,104 | 11/1972 | Tamplen | 166/240 X |
| 3,831,677 | 8/1974 | Mullins | 166/334 X |
| 4,050,512 | 9/1977 | Giebeler | 166/240 X |
| 4,101,157 | 7/1978 | Richey | 166/240 X |
| 4,355,685 | 10/1982 | Beck | 166/240 |
| 4,782,897 | 11/1988 | Zeller | 166/240 |

*Primary Examiner*—Stephen J. Novosad
*Attorney, Agent, or Firm*—William M. Imwalle; Paul I. Herman

[57] ABSTRACT

An improved mechanical system selectively locks the tester valve of an annulus pressure responsive tester valve in position for an indeterminate number of well annulus pressure cycles. The tester valve can be closed upon demand. The forces which accomplish opening of the ball valve act across a power piston, but the forces which close the valve act across an actuating piston. The tester valve can be run into a well with an operating element of the tester valve in a first position, such as a closed position. Upon reaching the desired depth within the well and setting of an associated packer system, well annulus pressure is then increased to a first level above hydrostatic pressure to move the power piston and thus move the tester valve to an open position. During a normal mode of operation, well annulus pressure can be cycled between hydrostatic pressure and the first level to open and close the tester valve. A fluid transfer assembly is included within the power piston which is operable to transfer fluid across the power piston. The tester valve also features a multi-range metering cartridge which is operable to meter fluid over a wide range of differential pressures.

9 Claims, 11 Drawing Sheets

MECHANICAL LOCKOUT FOR PRESSURE RESPONSIVE DOWNHOLE TOOL

This is a division, of application Ser. No. 08/238,417 filed May 5, 1994.

BACKGROUND OF THE INVENTION

1. Field of the Invention

The present invention relates to annulus pressure responsive downhole tester valves. Particularly, the present invention provides a mechanical means for locking the tester valve in a chosen position during subsequent changes in well annulus pressure.

2. Description of the Related Art

The related art includes a variety of downhole tools such as testing valves, circulating valves and samplers that are operated in response to a change in well annulus pressure. One particular type of annulus pressure responsive tool has previously been developed by the assignee of the present invention and is generally referred to as a low pressure responsive tool.

An example of such a low pressure responsive tester valve is shown in U.S. Pat. No. 4,667,743 to Ringgenberg et al. The low pressure responsive tool includes a ball-type tester valve operatively associated with a power piston having first and second sides communicated with the well annulus through first and second pressure conducting passages defined in the tester valve. A retarding means, such as a metering orifice, is placed in the second pressure conducting passage for delaying communication of a change in well annulus pressure to the second side of the power piston for a sufficient time to allow a pressure differential at the first side of the power piston to move the power piston downward. After a period of time, a pressure differential is built up at the second side of the power piston to move it upward. The movement of the power piston is typically accommodated by compression of a compressible gas such as nitrogen.

It is desirable with such tools to be able to selectively lock the power piston and the associated operating element of the tool in a chosen position so as to disable them during subsequent changes in well annulus pressure.

A hydraulic means for locking the tool is shown in U.S. Pat. No. 5,180,007. During normal operation of this type of tool, well annulus pressure is cycled between hydrostatic pressure and an increased first level above hydrostatic pressure to move a power piston and tester valve between the closed and open positions of the tester valve. The tester valve may be retained in an open position during reduction of well annulus pressure back to hydrostatic pressure by opening a bypass past the power piston, thereby deactivating the power piston. While the bypass is open, well annulus pressure can be decreased without moving the tester back to its closed position. The bypass is opened in response to increasing well annulus pressure to a second level which is higher than the first level. The power piston may be reactivated when the well annulus pressure is again raised to the second level. Hydraulic locking systems are advantageous in that they permit a tool to be held in a chosen position for an infinite number of well annulus pressure cycles. Current hydraulic locking designs, however, may be less reliable and more difficult to manufacture. Component parts for the bypass means are small and may be difficult to manufacture to precise dimensions at a low cost. Also, the complexity of the flow paths of the bypass means may provide a reliability problem. Metering through this bypass means may cause great variability in the upward travel of the actuating piston. The piston may fail to fully return to its initial position, causing premature activation of the "lock open" feature.

Mechanical position control schemes are known which use devices such as a lug and slot ratchet assembly attached to the power piston like that shown in Ringgenberg et al. U.S. Pat. No. 4,667,743. One disadvantage of this type of arrangement is that the power piston must move through a predetermined series of movements in order to obtain a selected position, as is determined by the various positions defined on the ratchet assembly. Also, the tool is only held in a chosen position for a predetermined number of well annulus pressure cycles. In addition, the pressure forces which open and close the valve both act across the power piston. As a result, subjecting the tool to pressure differentials across the power piston which are too great may damage the lugs of the ratchet assembly during opening or closing of the ball valve. The tool may become unreliable, difficult to operate or inoperable.

In another aspect, metering valve assemblies known in the art are inherently limited to the relatively narrow range of pressure differentials the valve assemblies are manufactured to be operable in response to. For example, a metering valve assembly which is designed to operate at a 5,000 psi pressure differential will be operable only around that range. If it is desired to operate a tester valve in well conditions at which a 10,000 psi differential exists, the tool must be disassembled to replace the metering valve assembly with one operable at a higher pressure differential. The oil and nitrogen contained within the tool is lost, and these fluids must be replaced.

SUMMARY OF THE INVENTION

The present invention provides an improved mechanical system for selectively locking the valve or other operating element of an annulus pressure responsive tool in an open position for an indeterminate number of well annulus pressure cycles. The operating element can be closed upon demand. In the featured embodiment, the forces which accomplish opening of the ball valve act across the power piston, but the forces which close the valve act across the actuating piston. The vulnerability of a tester valve to great pressure differentials is thereby reduced.

The tester valve can be run into a well with the operating element in a first position such as a closed position. Upon reaching the desired depth within the well and setting of an associated packer system, well annulus pressure is then increased to a first level above hydrostatic pressure to move the power piston and thus move the ball valve to an open position.

During a normal mode of operation, well annulus pressure can be cycled between hydrostatic pressure and the first level to open and close the ball valve. If desired, the ball valve may be placed into a "locked open" mode of operation wherein the well annulus pressure can be cycled between hydrostatic pressure and the first level, such as would be done to operate a pressure annulus device elsewhere in the testing string. To place the tester valve into the "locked open" mode, a second level of well annulus pressure, which is above the first level, is applied to the well annulus and then released. Reapplication and release of the second level of annulus pressure will enable a selectively actuatable load transfer assembly to close the associated ball valve and return the tester valve to its normal mode of operation.

The selectively actuatable axial load transfer assembly is operable to selectively transfer an axial load from a first tubular member to a second tubular member. The load transfer assembly comprises a first sleeve operably connected to the first tubular member, with this first sleeve presenting a radial surface and having a load transmitting member protruding from that surface. Such a load transmitting member could be a load transmitting shoulder. The load transfer assembly further comprises a second sleeve operably connected to the second tubular member to transmit an axial load thereto, this second sleeve presenting a radial surface complimentary to the radial surface of the first sleeve. This second sleeve has a load bearing member protruding from its radial surface, such as a load bearing shoulder, the load bearing member being operable to engage the load transmitting member of the first sleeve. The first and second sleeves together constitute a motion translation assembly which, upon axial motion of the first tubular member causes one of the sleeves to selectively bring the load transmitting member into engagement with the load bearing member.

A fluid transfer assembly is included within the power piston which is operable to transfer fluid across the power piston. The fluid transfer assembly includes a pressure relief valve and fluid restrictor which are operable to meter fluid in one direction across the power piston in an overpressure condition wherein the well annulus pressure is increased to a second level above the first level. The fluid transfer assembly also includes an oppositely disposed check valve to allow unrestricted fluid flow across the power piston in the opposite direction during a release and reduction of annulus pressure.

The tester valve also features a multi-range metering cartridge which is operable to meter fluid over a wide range of differential pressures. The metering cartridge provides an adjustable resistance flow path which permits fluid flow across the cartridge. The resistance of the flow path is adjustable by selectively diverting the fluid through a series of fluid flow resistors. Resistance may be increased either by adding a number of flow resistors serially or by adding a single flow resistor which itself provides a greater fluid flow resistance.

Numerous objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1A:
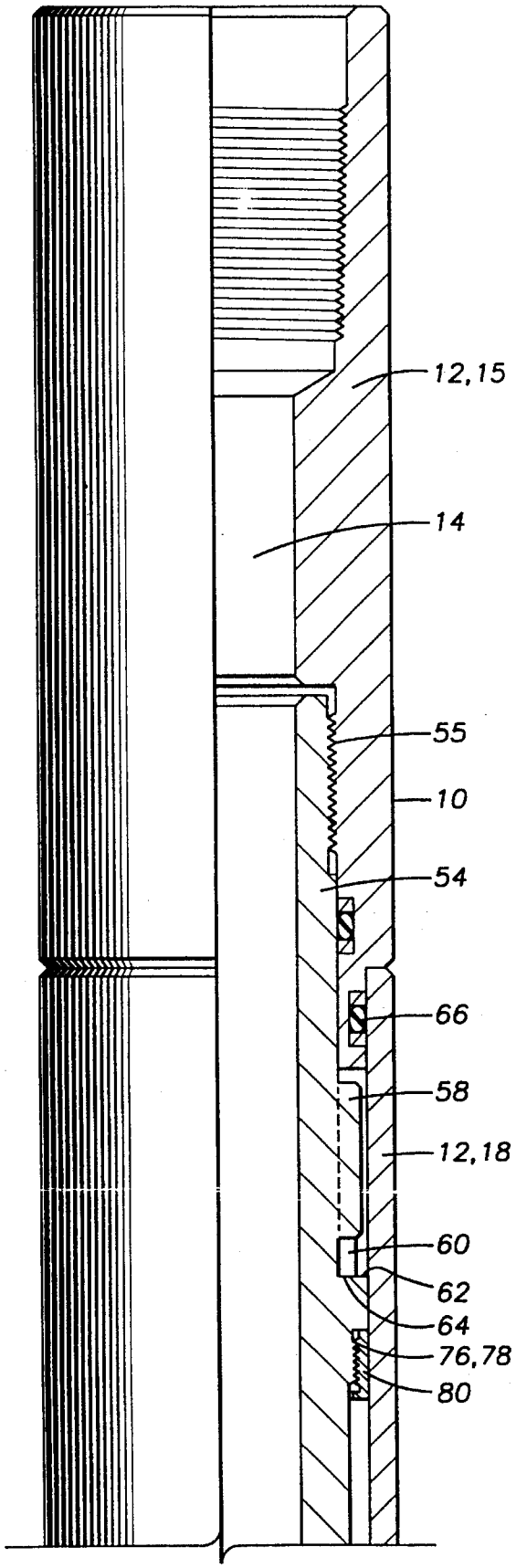
FIGS. 1A–1I comprise an elevation sectioned view of an annulus pressure responsive flow tester valve having a hydraulically actuated lockout for locking the tester valve in an open position.

Referring now to the drawings, and particularly to FIGS. 1A–1I, a flow tester valve 10, which may also be generally referred to as an annulus pressure responsive tool 10, is shown.

The tester valve 10 is used with a formation testing string during the testing of an oil well to determine production capabilities of a subsurface formation. The testing string will be lowered into a well such that a well annulus is defined between the test string and the well bore hole. A packer associated with the tester valve 10 will be set in the well bore to seal the well annulus below the power port 214 of valve 10, as hereinafter described in detail, which is then subsequently operated by varying the pressure in the well annulus.

Such a flow test string in general is well known. A detailed description of a general makeup of such a testing string as utilized in an offshore environment and indicating the location of a tester valve in such a string is shown for example in U.S. Pat. No. 4,537,258 to Beck with regard to FIG. 1 thereof, the details of which are incorporated herein by reference.

Referring now to FIGS. 1A–1I of the present application, the tester valve apparatus 10 of the present invention includes a housing 12 having a central flow passage 14 disposed longitudinally therethrough.

The housing 12 includes an upper adapter 16, a valve housing section 18, an ported nipple 20, power housing section 22, connector section 24, an upper gas chamber housing section 26, a gas filler nipple 28, a lower gas chamber housing section 30, a metering cartridge housing 32, a lower oil chamber housing section 34 and a lower adapter 36. The components just listed are connected together in the order listed from top to bottom with various conventional threaded and sealed connections. The housing 12 also includes an upper inner tubular member 38, an inner connector 40, and a lower inner tubular member 42.

The upper inner tubular member 38 is threadedly connected to gas filler nipple 28 at thread 44 and sealingly received within bore 46 to be affixed to inner connector 40 below. Lower gas chamber housing 30 is attached to inner connector 40 at thread 47. Conventional O-ring seals 49 seal the connections. Lower inner tubular member 42 is threadedly connected to inner connector 40 at thread 48. Lower inner tubular member 42 is sealingly received within a bore 50 of lower adapter 36 with an O-ring seal 52 being provided therebetween.

An upper seat holder 54 is threadedly connected to upper adapter 16 at thread 56. Upper seat holder 54 has a plurality of radially outward extending splines 58 which mesh with a plurality of radially inward extending splines 60 of valve housing section 18. Upper seat holder 54 includes an annular upward facing shoulder 62 which engages lower ends 64 of splines 60 of valve housing section 18 to thereby hold value housing section 18 in place with the lower end of upper adapter 16 received in the upper end of valve housing section 18 with a seal 66 being provided therebetween.

An annular upper valve seat 68 is received in upper seat holder 54, and a spherical ball valve member 70 engages upper seat 68. Ball valve member 70 has a bore 72 disposed therethrough. In FIG. 1 the ball valve member 70 is shown in its open position so that the bore 72 of ball valve 70 is aligned with the longitudinal flow passage 14 of tester valve 10. As will be further described below, when the ball valve 70 is rotated to its closed position the bore 72 thereof is isolated from the central flow passage 14 of tester valve 10.

The ball valve 70 is held between upper seat 68 and a lower annular seat 74. Lower annular seat 74 is received in a lower seat holder mandrel 76. The lower seat holder mandrel 76 is a cylindrical cage-like structure having an upper end portion 78 threadedly connected to upper seat holder 54 at thread 80 to hold the two together with the ball valve member 70 and seats 68 and 74 clamped therebetween. A Belleville spring 82 is located below lower seat 74 to provide the necessary resilient clamping of the ball valve member 70 between seats 68 and 74.

The cylindrical cage-like lower seat holder 76 has two longitudinal slots, one of which is visible in FIG. 1 and designated by the numeral 84. Within each of the slots such as 84 there is received an actuating arm such as the one visible in FIG. 1 and designated as 86. Actuating arm 86 has an actuating lug 88 disposed thereon which engages an eccentric bore 90 disposed through the side of ball valve member 70 so that the ball valve member 70 may be rotated to a closed position upon upward movement of actuating arm 86 relative to the housing 12 as seen in FIG. 1. Actually, there are two such actuating arms 86 with lugs 88 engaging two such eccentric bores such as 90. The details of the ball valve actuation are illustrated and described in detail in U.S. Pat. No. 3,856,085 to Holden et al. and assigned to the assignee of the present invention.

An operating mandrel assembly 92 includes an upper operating mandrel portion 94, and intermediate operating mandrel portion 96, and a lower operating mandrel portion 98. The operating mandrel 96 serves as the second tubular member of the selectively actuatable axial load transfer assembly in this embodiment.

The upper operating mandrel portion 94 includes a radially outer annular groove 100 disposed therein which engages a radially inwardly extending shoulder 102 of actuating arm 86 so that actuating arm 86 reciprocates with the upper operating mandrel portion 94 within the housing 12.

The lower seat holder mandrel 76 has an outer surface 104 closely received within an inner cylindrical bore 106 of the upper operating mandrel portion 94 with a seal being provided therebetween by annular seal 108.

An upper portion of intermediate operating mandrel portion 96 is received within a smaller bore 110 of upper operating mandrel portion 94. Upper operating mandrel portion 94 carries a plurality of locking dogs 112 each disposed through a radial window 114 in upper operating mandrel portion 94 with a plurality of annular biasing springs 116 received about the radially outer sides of locking dogs 112 to urge them radially inward through the windows 114 against the intermediate operating mandrel portion 96.

The operating mandrel assembly 92 is seen in FIGS. 1A–1F where the valve is in an initial run-in open position wherein the ball valve element 70 is open as shown. The tester valve apparatus 10, however, can also be initially run into the well with the ball valve member 70 in a closed position. This is accomplished as follows.

The intermediate operating mandrel portion 96 carries an annular radially outer groove 118 which in FIG. 1 is shown displaced above the locking dogs 112. The intermediate operating mandrel portion 96 slides freely relative to the upper operating mandrel portion 94 until the locking dogs 112 are received within the annular groove 118. Thus, referring to the view of FIG. 1B, the tester valve 10 could be initially assembled with the upper operating mandrel portion 94 displaced upwardly relative to housing 12 and intermediate operating mandrel portion 96 from the position shown in FIG. 1B such that the locking dogs 112 are received and locked in place in groove 118 with the ball valve member 70 rotated to a closed position.

Figure 1B:
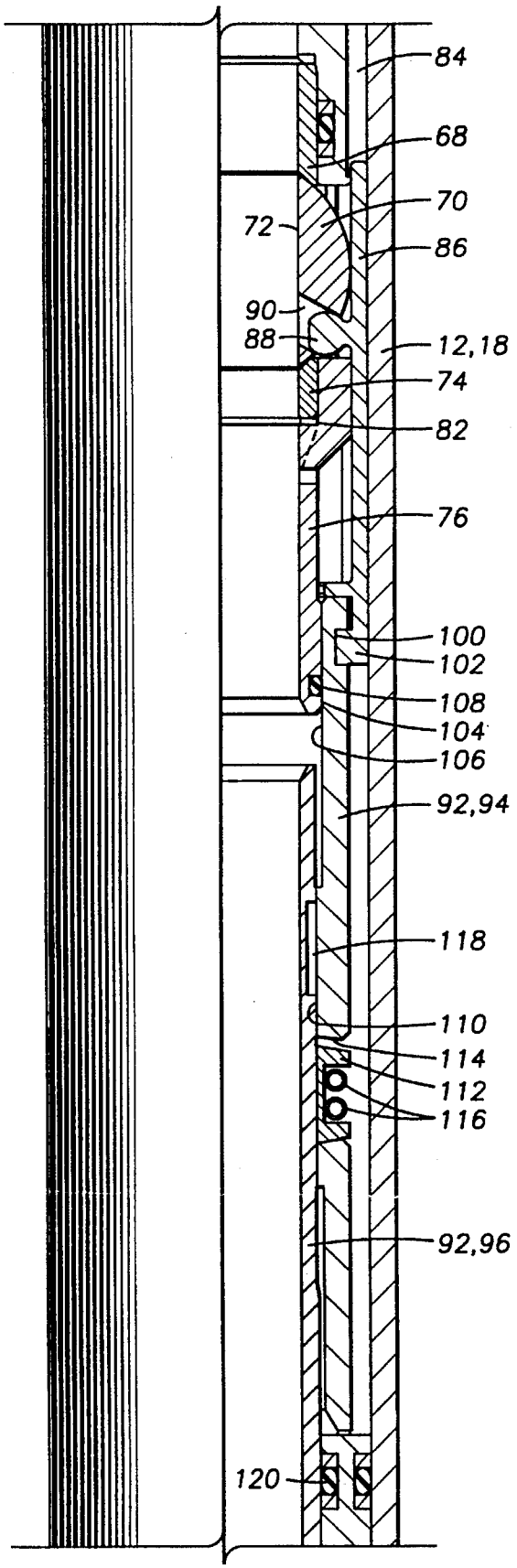

On the other hand, if the tester valve 10 is run into the well with the ball valve 70 in an open position as illustrated in FIG. 1B, the intermediate operating mandrel portion 96 will subsequently be moved downward in a manner further described below toward what would normally be the open position of the tester valve 10. When the intermediate operating mandrel portion 96 has moved sufficiently downward, the locking dogs 112 will lock into place in the groove 118 thus locking the upper operating mandrel portion 94 to the intermediate operating mandrel portion 96 so that subsequent movements of the intermediate operating mandrel portion 96 by the power piston, actuating piston and other components as further described below will act to move the upper operating mandrel portion 94 along with the actuating arm 86 to rotate the ball 70 between its open and closed positions as desired. The operating mandrel assembly 92 will move upward relative to housing 12 to rotate the ball valve 70 to a closed position and will move downward relative to the housing 12 to rotate the ball valve member 70 to the open position.

The intermediate operating mandrel portion 96 is closely slidably received within a bore 119 of ported nipple 20 with an O-ring seal 120 being provided therebetween. Intermediate operating mandrel portion 96 includes a radially outwardly extending flange 122.

An annular mud chamber 130 is defined between ported nipple 20 and intermediate operating mandrel portion 96. One or more power ports 132 are radially disposed through ported nipple 20 to communicate a well annulus surrounding tester valve 10 with the mud chamber 130.

An annular oil power chamber 134 is defined between power housing section 22 and intermediate operating mandrel portion 96. An actuating piston 136 is slidably received within the annular oil power chamber 134 with an outer seal 138 sealing against power housing section 22 and an inner seal 140 sealing against intermediate operating mandrel portion 96. The actuating piston 136 presents an upper side 133 and lower side 135, and serves as the first tubular member of the selectively actuatable axial load transfer assembly in this embodiment.

The actuating piston 136 serves to isolate well fluid, typically mud, which enters the power port 132 from hydraulic fluid, typically oil, contained in the oil power chamber 134.

The actuating piston 136 is connected at lower threads 124 to load transfer sleeve 126 which serves as the first sleeve of the selectively actuatable axial load transfer assembly in this embodiment, and which presents four inwardly protruding load transfer shoulders proximate its lower end. These load transfer shoulders serves as the load transfer member of the selectively actuatable axial load transfer assembly in this embodiment. One of these shoulders is shown at 128 in FIG. 1C. The load transfer shoulders 128 present upwardly facing contact surfaces **128*a*. A bearing race (not shown) of slightly enlarged diameter is disposed about the inner circumference of the load transfer sleeve 126. A bearing insertion aperture (also not shown) is disposed through the load transfer sleeve 126** proximate the bearing race.

Split ring 139 and shoulder 147 fixedly surround the intermediate operating mandrel portion 96 and limit upward axial movement of the ratchet sleeve 127 with respect to the intermediate operating mandrel portion 96. A snap ring 149 fixedly surrounds the intermediate operating mandrel portion 96 proximate the lower end of the ratchet sleeve 127 to limit downward axial movement of the ratchet sleeve 127.

Figure 1C:
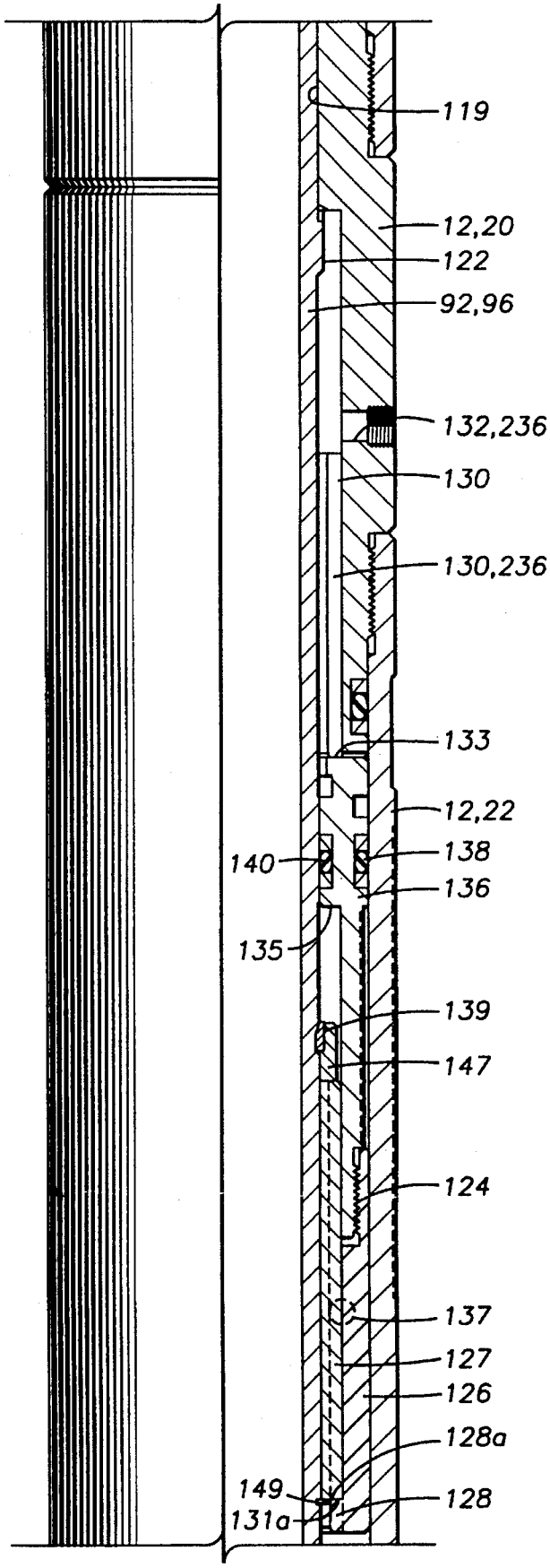
Figure 1D:
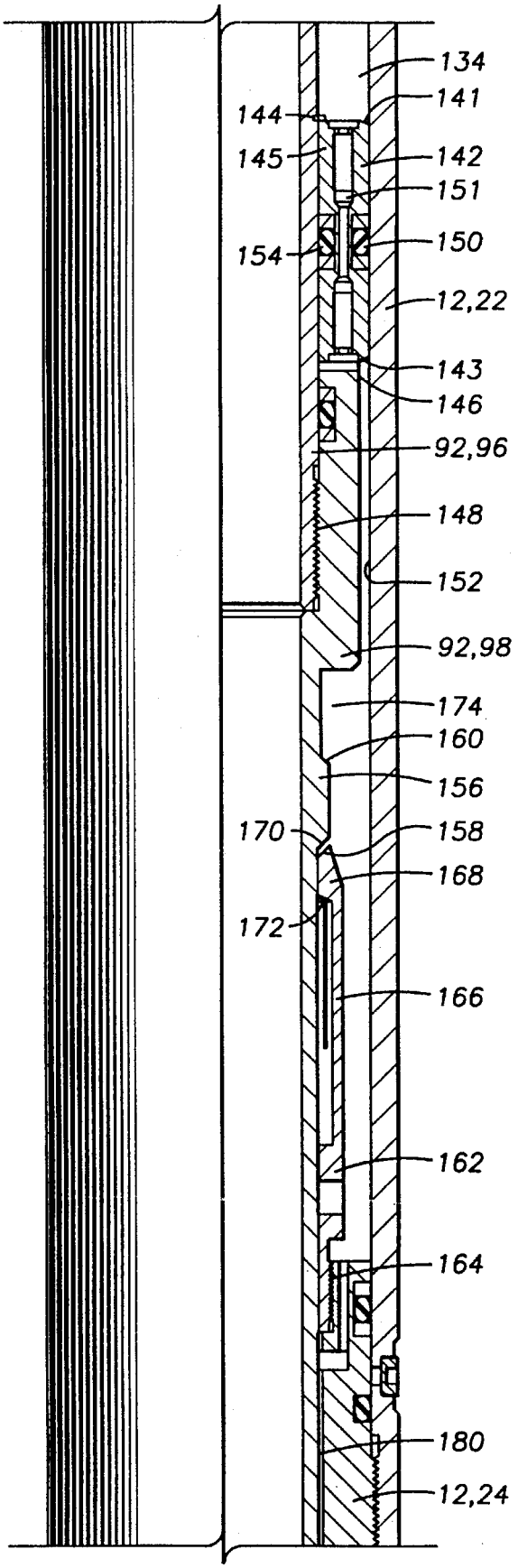
Figure 1E:
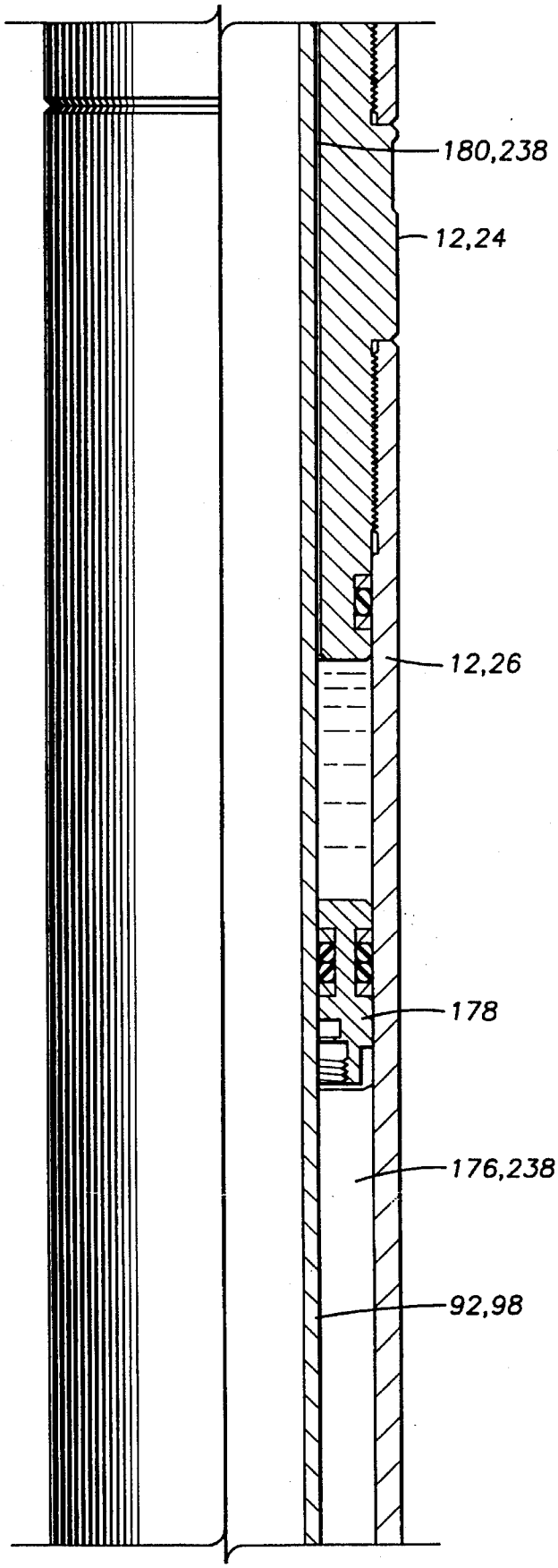
Figure 1F:
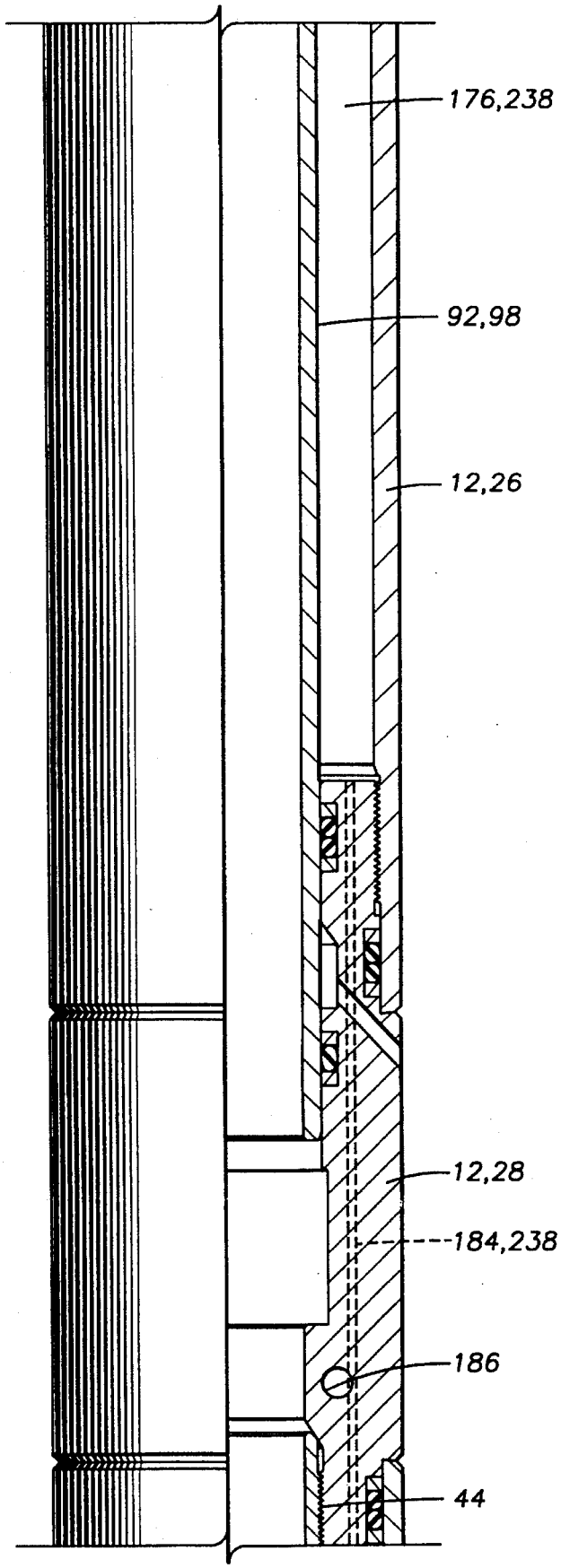
Figure 1G:
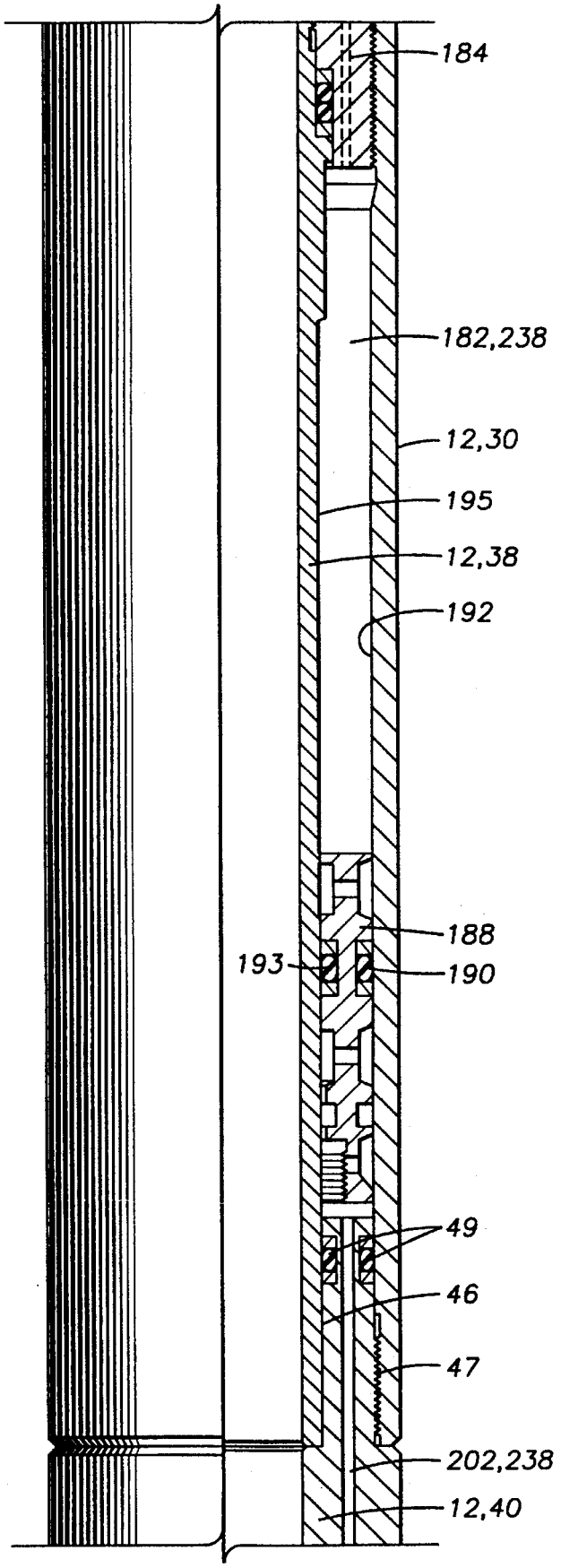
Figure 3:
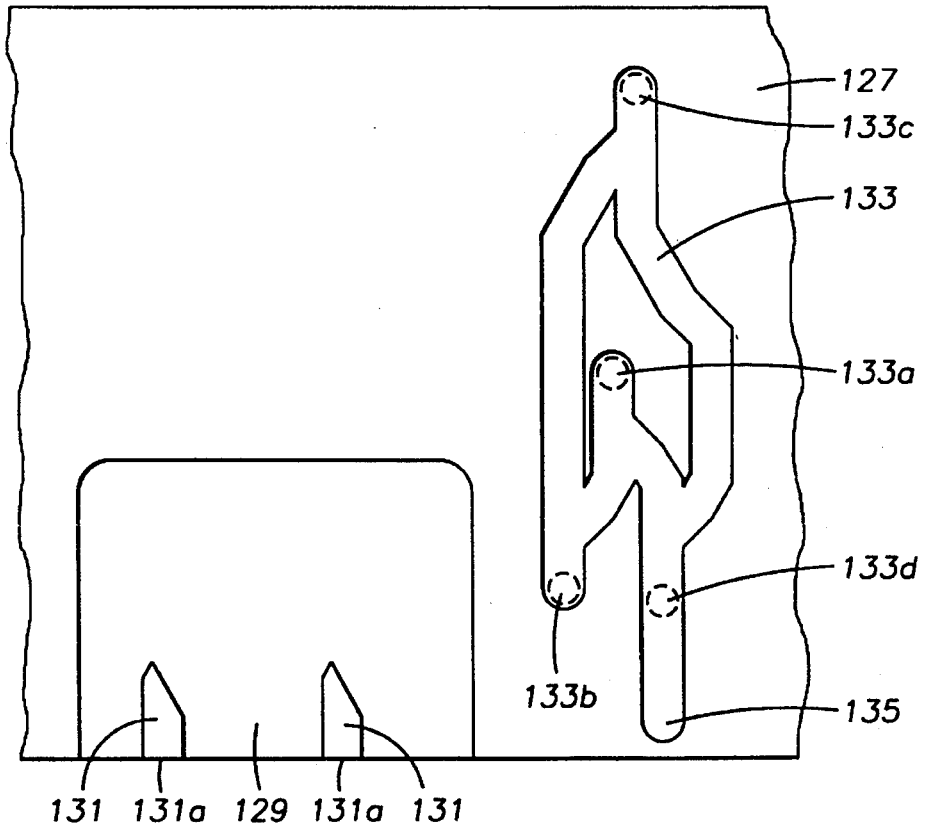
FIG. 3 is an exterior view of a portion of an exemplary ratchet sleeve constructed in accordance with the present invention.

Referring now to FIGS. 1C and 3, a ratchet sleeve 127 surrounds the intermediate operating mandrel portion 96 and is loosely received within load transfer sleeve 126. The ratchet sleeve 127 is axially rotatable upon the intermediate mandrel portion 96. The ratchet sleeve 126 serves as the second sleeve of the selectively actuatable axial load transfer assembly in this embodiment. The outer surface of an exemplary ratchet sleeve 127 is shown in FIG. 3. A milled out area 129 is located proximate the lower end and upon the outer circumference of the ratchet sleeve 127. The milled out area 129 is a section of sufficiently reduced thickness on the ratchet sleeve 127 to permit load transfer shoulders 128 of the load transfer sleeve 126 to be moved freely adjacent thereto. Load bearing shoulders 131 which present downwardly facing contact surfaces 131*a* are provided proximate the lower end of ratchet sleeve 127. The load bearing shoulders 131 serve as the load bearing member of the selectively actuatable axial load transfer assembly in this embodiment. There are preferably four outward load bearing shoulders 131*a* disposed about the outer circumference of the ratchet sleeve 127 positioned so as to be in complimentary engagement with load transfer shoulders 128 of the load transfer sleeve 126. Bearing slot grooving 133 is provided on the outer circumference of the ratchet sleeve 127 which is shaped and sized to receive a bearing. The bearing slot grooving 133 includes a first bearing stop position 133*a*, a second bearing stop position 133*b*, bearing stop position 133*c* and fourth bearing stop position 133*d* shown in phantom lines in FIG. 3. Bearing installation grooving 135 is provided which is deeper than the bearing slot grooving 133. It is preferred that there be two arrangements of bearing slot grooving 133 located on opposing sides of the ratchet sleeve 127. Similarly, there would be two such milled out areas 129 with protruding load bearing shoulders 131. While load transfer shoulders 128 are engaged with load bearing shoulders 131 of the ratchet sleeve 127, upward axial load may be transmitted to the ratchet sleeve 127, shoulder 147 and intermediate operating mandrel portion 96 such that the ball valve 70 may be closed by an upward pressure differential upon the lower side 135 of actuating piston 136. Upward loading on the actuating piston 136 causes the load transfer sleeve 126 to transfer its upward load through the engagement of load transfer shoulders 128 and load bearing shoulders 131 to ratchet sleeve 127, shoulder 147 and, thereby, to operating mandrel assembly 92.

The ratchet sleeve 127 and the load transfer sleeve 126 operate together as the motion translation assembly of the selectively actuatable axial load transfer assembly in this embodiment.

The ratchet sleeve 127 and load transfer sleeve 126 are operatively associated as a ratchet assembly by insertion of a bearing 137 into the insertion aperture when the insertion aperture is aligned with the installation grooving 135 of the ratchet sleeve 127. By manipulating the ratchet sleeve 127, the bearing 137 is then captured and moved within the bearing race and the bearing slot grooving 133. In operation, the arrangement functions as a selectively actuatable load transfer assembly which provides for translation of axial motion by the load transfer sleeve 126 as movement of the bearing 137 along the bearing slot grooving 133 rotates the ratchet sleeve 127 with respect to the load transfer sleeve 126, and, as will be described, selectively brings the load transfer shoulders 128 of the load transfer sleeve 126 into engagement with the load bearing shoulders 131 of the ratchet sleeve 127.

As the tester valve 10 is run into the well with the ball valve 70 in an open position, the bearing 137 is located initially at the first bearing stop position 133*a*. In this position, the load transfer shoulders 128 are engaged with the load bearing shoulders 131 such that faces 128*a* contact faces 131*a* and will permit transfer of an axial load thereacross. Movement of the load transfer sleeve 126 axially downward causes the bearing 137 to be moved within the bearing race along the bearing slot grooving 133 to its second bearing stop position 133*b*. The ratchet sleeve 127 is rotated slightly and the load transfer shoulders 128 are moved out of engagement with the load bearing shoulders 131. From this position, movement of the load transfer sleeve 126 upward causes the bearing 137 to be moved within the bearing race along the bearing slot grooving 133 to its third bearing stop position 133*c*. During this movement, the load transfer shoulders 128 remain out of engagement with the load bearing shoulders 131 and are moved about them to points adjacent the milled out area 129. From this position, movement of the load transfer sleeve 126 downward causes the bearing 137 to be moved along the bearing slot grooving 133 towards its fourth bearing stop position 133*d*. The load transfer shoulders are moved below the load bearing shoulders 131 and remain out of engagement with them. Finally, movement of the load transfer sleeve 126 axially upward will move the bearing 137 from its fourth bearing stop position 133*d* back to the first bearing stop position 133*a*. The ratchet sleeve 127 will be rotated, and once again, the load transfer shoulders 128 of the load transfer sleeve 126 will be brought into engagement with the load bearing shoulders 131 of the ratchet sleeve.

Referring once more to FIG. 1D, an annular power piston 142 is fixedly attached to the operating mandrel assembly 92 and is held in place between a downward facing shoulder 144 of a snap ring mounted on intermediate operating mandrel portion 96 and an upper end 146 of lower operating mandrel portion 98. The intermediate operating mandrel portion 96 and lower operating mandrel portion 98 are threadedly connected at thread 148 after the power piston 142 has been placed about the intermediate operating mandrel portion 96 below the shoulder 144.

Power piston 142 has a shoulder 145 which engages the shoulder 144 of intermediate operating mandrel portion 96. In the embodiment shown here, the shoulder 144 of intermediate operating mandrel portion 96 is provided by a lock ring engaging a groove formed in intermediate operating mandrel portion 96.

The power piston 142 has an upper side 141 and a lower side 143. Power piston 142 also carries an outer annular seal 150 which provides a sliding seal against the wall of an inner cylindrical bore 152 of the power housing section 22 and an inner annular seal 154 which seals against the intermediate operating mandrel portion 96.

Figure 2:
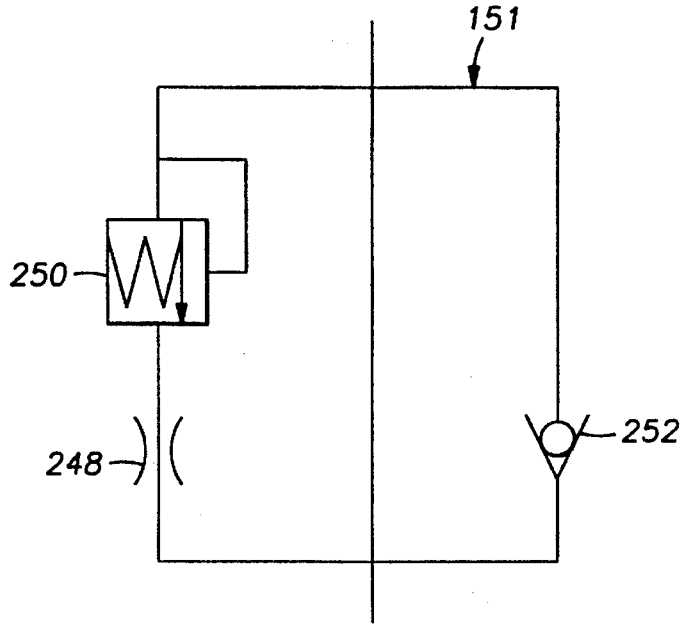
FIG. 2 is a schematic illustration of the fluid transfer assembly of the power piston.

A fluid transfer assembly 151 is included within the power piston 142 to permit fluid transfer across the power piston 142. The fluid transfer assembly 151 is diagrammed schematically in FIG. 2. The fluid transfer assembly 151 includes a pressure relief valve 250 and fluid restrictor 248. The pressure relief valve 250 should provide sufficient resistance so that it will not open until the annulus has been overpressured to a second level which is above the first pressure level needed to move the power piston 142 and valve member 70 between the closed and open positions. The relief valve 250 is thereby set so that it will not open during normal operation of the tester valve 10. Thus the tester valve 10 is normally operated by increasing well annulus pressure to, for example, 1,000 psi above hydrostatic well annulus pressure, the pressure relief valve 250 is designed to require greater than 1,000 psi to open.

The fluid restrictor 248 slows transfer of fluid from the upper side 141 to the lower side 143 of the power piston 142.

The fluid transfer assembly 151 also includes a check valve 252, which is oppositely disposed from pressure relief valve 250 and fluid restrictor 248. The check valve 252 permits unrestricted fluid flow from the lower side 143 to the upper side 141 of the power piston.

When the power piston 142 is moved downward relative to housing 12 due to pressure differentials thereacross, the operating mandrel assembly 92 moves therewith to move the ball valve element 70 to its open position. A rapid increase in well annulus pressure will be immediately transmitted to the upper side 141 of power piston 142, but will be delayed in being communicated with the lower side 143 of power piston 142, so that a rapid increase in well annulus pressure will create a downward pressure differential across the power piston 142 thus urging it downward within the housing 12.

Downward motion of the power piston 142 within the housing 12 is transmitted by the operating mandrel assembly 92 to operate the ball valve 70 and rotate it to its open position in response to increased well annulus pressure.

The lower operating mandrel portion 98 carries a radially outward extending flange 156 having a lower tapered shoulder 158 and an upper tapered shoulder 160 defined thereon.

A spring collet retaining means 162 has a lower end fixedly attached to connector section 24 at thread 164. A plurality of upward extending collet fingers 166 are radially inwardly biased. Each finger 166 carries an upper collet head 168 which has the upper and lower tapered retaining shoulders 170 and 172, respectively, defined thereon.

In the initial position of lower operating mandrel portion 98 as seen in FIG. 1, the collet head 168 is located immediately below flange 156 with the upper tapered retaining shoulder 170 of collet head 168 engaging the lower tapered shoulder 158 of the flange 156 of lower operating mandrel portion 98. This engagement prevents the operating mandrel assembly 92 from moving downward relative to housing 12 until a sufficient downward force is applied thereto to cause the collet fingers 166 to be cammed radially outward and pass up over flange 156 thus allowing operating mandrel assembly 92 to move downward relative to housing 12. Similarly, subsequent engagement of upper tapered shoulder 160 of flange 156 with lower tapered retaining shoulder 172 of collet head 168 will prevent the operating mandrel assembly 92 from moving back to its upwardmost position relative to housing 12 until a sufficient pressure differential is applied thereacross. In a preferred embodiment of the invention, the spring collet 162 is designed so that a differential pressure in the range of from 500 to 700 psi is required to move the operating mandrel assembly 92 past the spring collet 162. Thus the spring collet 162 prevents premature movement of operating mandrel assembly 92 in response to unexpected annulus pressure changes.

An irregularly shaped annular oil balancing chamber 174 is defined between power housing section 22 and lower operating mandrel portion 98 below power piston 142. Oil balancing chamber 174 is filled with a hydraulic fluid such as oil.

An upper annular nitrogen chamber 176 is defined between upper gas chamber housing section 26 and lower operating mandrel portion 98. An annular upper floating piston or isolation piston 178 is slidably received within nitrogen chamber 176.

A plurality of longitudinal passages 180 are disposed through an upper portion of upper gas chamber housing section 26 to communicate the oil balancing chamber 174 with the upper end of nitrogen chamber 176. The floating piston 178 isolates hydraulic fluid thereabove from a compressed gas such as nitrogen located therebelow in the upper nitrogen chamber 176.

An annular lower nitrogen chamber 182 is defined between lower gas chamber housing section 30 and upper inner tubular member 38. A plurality of longitudinally extending passages 184 are disposed through gas filler nipple 28 and communicate the upper nitrogen chamber 176 with the lower nitrogen chamber 182. A transversely oriented gas fill port 186 intersects passage 184 so that the upper and lower nitrogen chambers 176 and 182 can be filled with pressurized nitrogen gas in a known manner. A gas filler valve (not shown) is disposed in gas fill port 186 to control the flow of gas into the nitrogen chambers and to seal the same in place therein. The nitrogen chambers 176 and 182 serve as accumulators which store increases in annulus pressure that enter the tester valve 10 through power ports 132 above and through equalizing port 214, which will be described shortly, below. The nitrogen accumulators also function to balance the pressure increases against each other and, upon subsequent reduction of annulus pressure, to release the stored pressure to cause a reverse pressure differential within the tester valve 10.

A lower floating piston or isolation piston 188 is slidingly disposed in the lower end of lower nitrogen chamber 182. It carries an outer annular seal 190 which seals against an inner bore 192 of lower gas chamber housing section 30. Piston 188 carries an annular inner seal 193 which seals against an outer cylindrical surface 195 of upper inner tubular member 38.

The lower isolation piston 188 isolates nitrogen gas in the lower nitrogen chamber 182 thereabove from a hydraulic fluid such as oil contained in the lower most portion of chamber 182 below the piston 188.

Figure 1H:
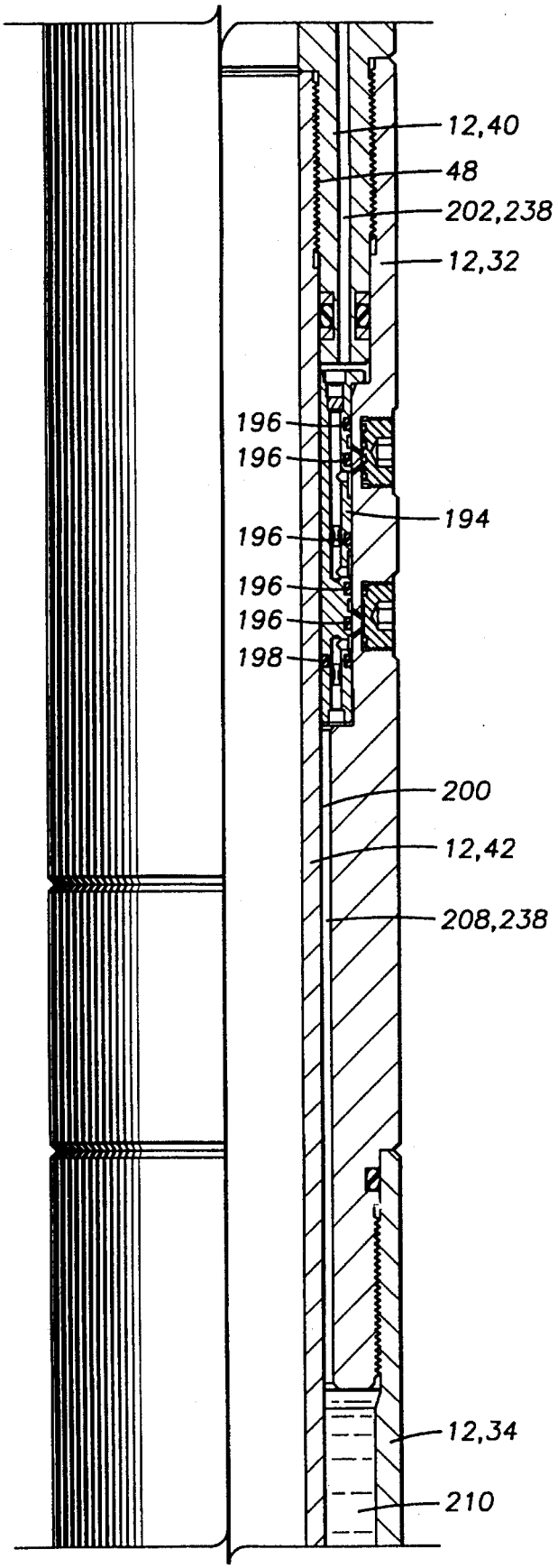
Figure 4:
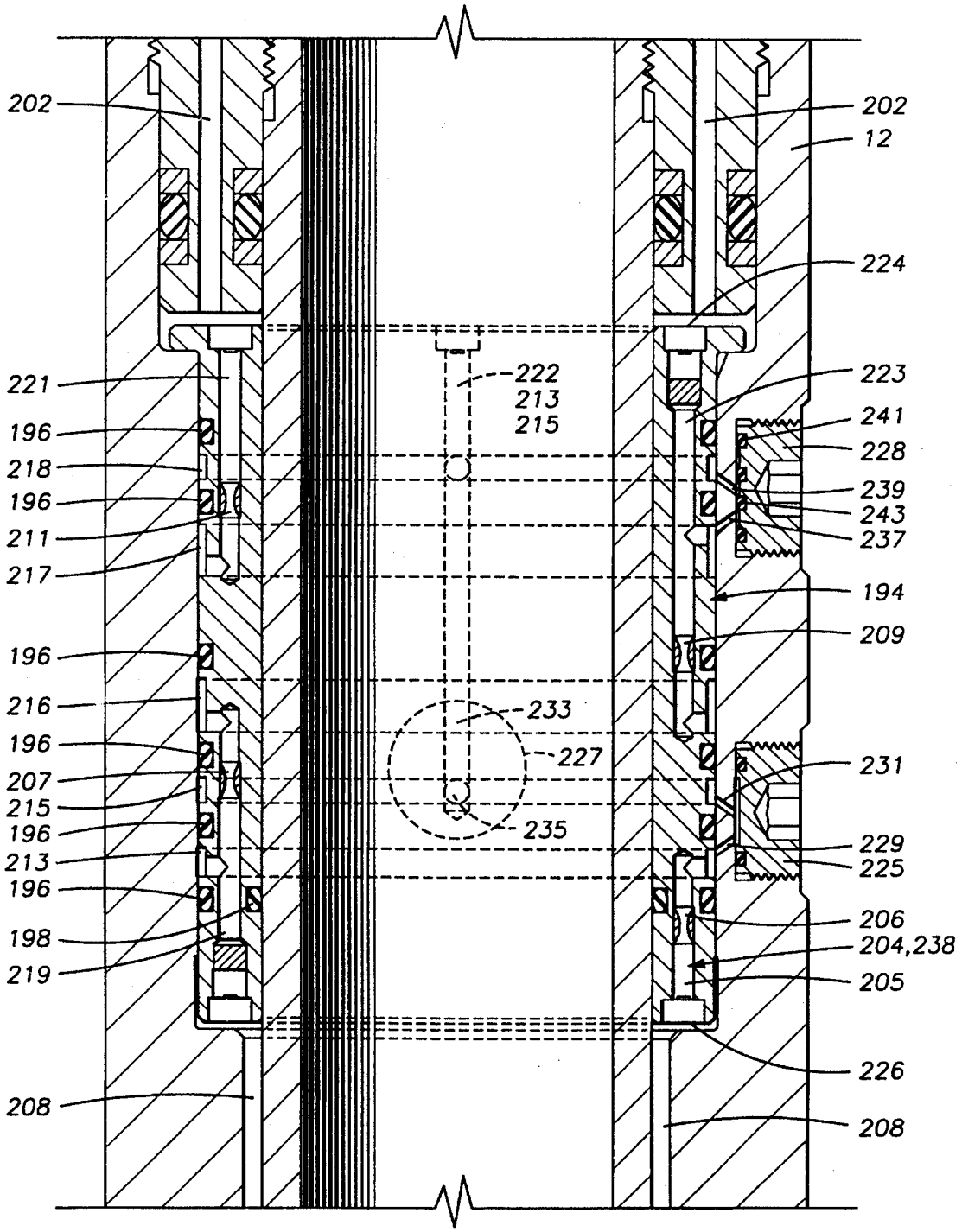
FIG. 4 is a full section view of an exemplary multi-range metering cartridge constructed in accordance with the present invention.

Referring now to FIGS. 1H and 4, an annular multi-range metering cartridge 194 is located longitudinally between inner tubular member connector 40 and the metering cartridge housing 32, and is located radially between the metering cartridge housing 32 and the lower inner tubular member 42. The multi-range metering cartridge 194 is fixed in place by the surrounding components just identified and is adjustable to meter fluid over a wide range of differential pressures. Metering cartridge 194 carries outer annular seal 196 which seals against the inner bore of metering cartridge housing 32. Multi-range metering cartridge 194 carries an annular inner seals 198 which seal against a cylindrical outer surface 200 of lower inner tubular member 42.

An upper end of multi-range metering cartridge 194 is communicated with the lower nitrogen chamber 182 by a plurality of longitudinal passageways 202 cut in the radially outer portion of inner tubular member connector 40.

Figure 1I:
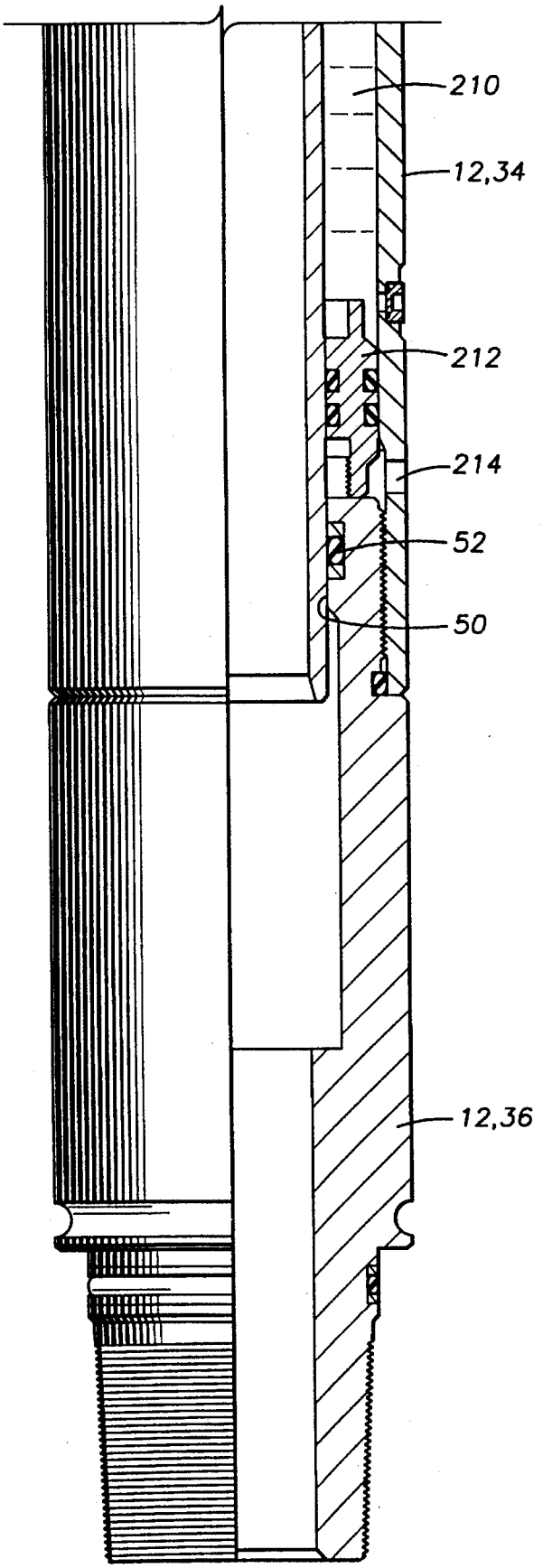

Referring now to FIG. 1I, the multi-range metering cartridge 194 has an adjustable resistance flow path, indicated generally at 204, therethrough which communicates the oil passages 202 thereabove with an annular passage 208 therebelow which leads to a lower oil filled equalizing chamber 210. A lowermost floating piston or isolation piston 212 is slidably disposed in equalizing chamber 210 and isolates oil thereabove from well fluids such as mud which enters therebelow through an equalizing port 214 defined through the wall of lower oil chamber housing section 34.

Details of an exemplary multi-range metering cartridge 194 are best seen in the enlarged full section view of FIG. 4. The cartridge 194 includes four flow restrictors 206, 207, 209 and 211. Each flow restrictor comprises a small orifice jet which impedes the flow of fluid from equalizing chamber 210 towards the oil passages 202 so as to provide a time delay in the transmission of upward moving increases in well annulus pressure toward the lower side 143 of power piston 142 and the lower side 135 of the actuating piston 136. The flow restrictors also function to provide a time delay during reduction of annulus pressure and the release of stored pressure within the nitrogen chambers 176 and 182 as the stored pressure attempts to escape back into the annulus through equalization port 214. In a preferred embodiment, first flow restrictor 206 provides a resistance of 8.08 k-lohms, second flow restrictor 207 provides a resistance of 14.5 k-lohms, third flow restrictor 209 provides a resistance of 27.3 k-lohms, and fourth flow restrictor 211 provides a resistance of 46.8 k-lohms. Fluid flow restrictors having these liquid resistances are available from the Lee Company at Westbrook, Conn.

Annular grooves 213, 215, 216, 217 and 218 surround the exterior circumference of the cartridge 194. These grooves are sized for fluid transmission about the circumference of the cartridge 194 when the cartridge 194 is affixed within the structure of housing 12. There is a lower fluid entrance port 205 which is adapted to receive fluid from annular passage 208 below. There is also a fluid conduit 219 proximate the lower portion of the cartridge 194 which is closed to fluid communication with passage 208. There are two upper fluid exit ports 221, 222 proximate the upper portion of the cartridge 194. Fluid conduit 223 is closed against fluid communication with passage 202 thereabove. Upper and lower screens 224 and 226 cover the ends of cartridge 194.

Three threaded plugs 225, 227 and 228 are located within the surrounding housing 12. The plugs are adapted for ready insertion and removal from outside the housing 10 with a proper tester valve such as a wrench. When inserted, the plugs form fluid tight seals with the assistance of inner and outer elastomeric O-ring seals as will be explained. Passages 229 and 231 connect plug 225's location with grooves 213 and 215, respectively and will permit fluid communication therebetween. Similar passages 233 and 235 connect plug 227's location with grooves 216 and 215, respectively, and passages 237 and 239 connect plug 228's location with grooves 217 and 218. These passages should be of sufficient size that fluid would tend to pass through the passages from one groove to another rather than pass through a fluid restrictor in a parallel path.

Plugs are chosen for selective blockage of fluid communication between these passages and thus between the grooves. In this way, the flow path 204 can be diverted to pass through some or all of the fluid restrictors. Exemplary plugs 225 and 228 are shown to be generally similar and each include an outer elastomeric O-ring seal 241 surrounding a portion of their insertion ends which, when the plug is tightened within the plug hole it creates a fluid seal. Plug 228 differs from plug 225, however, in that it includes an additional inner O-ring seal 243 surrounding a portion of its insertion end. Plugs without this inner O-ring seal, like plug 225, will be referred to as open plugs. Plugs with the inner O-ring seal 243 will be referred to as closed plugs. By replacing open plug 225 with a closed plug, fluid flow from adjacent passage 229 would be blocked from entering passage 231. Closed plugs then may be thought of as flow path diversions.

The flow path 204 controls the flow of oil upward from equalizing chamber 210 to the underside of lower isolation piston 188. Upon changes in differential pressures, oil may flow back toward the equalizing chamber 210 along the same flow path 204. In the embodiment shown in FIG. 4, the flow path 204 includes inlet port 205 and at least one fluid exit port 221 or 222.

If the components are configured as shown in FIG. 4 and it is assumed that plug 227 is a closed plug to block fluid flow between adjacent passages 233 and 235, flow path 204 includes inlet port 205, first flow restrictor 206, annular groove 213, passages 229 and 231 and fluid exit port 222. Since the fluid will pass only through fluid restrictor 206, the flow path 204 will provide a resistance of 8.08 k-lohms.

Replacement of two of the plugs will add second flow restrictor 207 to the flow path 204. If plug 225 is a closed plug, plug 227 an open plug and plug 228 a closed plug, flow path 204 includes inlet port 205, first flow restrictor 206, annular groove 213, conduit 219, second flow restrictor 207, annular groove 216, passages 233 and 235, annular groove 215 and exit port 222.

If the plugs are replaced so that plugs 225 and 227 are closed and plug 228 is open, third flow restrictor 209 is added to flow path 204. In this configuration, flow path 204 includes inlet port 205, first flow restrictor 206, annular groove 213, conduit 219, second flow restrictor 207, annular groove 216, third flow restrictor 209, conduit 223, passages 237 and 239, annular groove 218, and exit port 222.

Finally, if the plugs are replaced so that plugs 225, 227 and 228 are all closed plugs, fluid will be forced to flow through all four flow restrictors. Flow path 204 will include inlet port 205, first flow restrictor 206, annular groove 213, conduit 219, second flow restrictor 207, annular groove 216, third flow restrictor 209, conduit 223, annular groove 217, fourth flow restrictor 211 and exit port 221.

A multi-range metering cartridge which is constructed in accordance with this preferred embodiment will provide fluid flow restriction along the flow path 204 which may be varied from 8.08 k-lohms to 96.68 k-lohms by selective use of open and closed plugs. Although different tool sizes and hydrostatic pressure ranges will dictate particular flow restriction requirements, this range of restriction is generally useful for tool designs exposed to between 2 ksi and 14 ksi hydrostatic pressures. A cartridge providing this range of restriction is optimal for a 5 inch O.D. size tool.

The housing 12 can be generally described as having a first pressure conducting passage means 236 defined therein for communicating the well annulus with the upper side 141 of power piston 142. The first pressure conducting passage means 236 includes power port 132, annular mud chamber 130, and oil power chamber 134.

The housing 12 can also be generally described as having a second pressure conducting passage means 238 defined therein for communicating the well annulus with the lower side 135 of actuating piston 136. The second pressure conducting passage means 238 includes oil power chamber 134, oil balancing chamber 174, longitudinal passage 180, upper nitrogen chamber 176, longitudinal passage 184, lower nitrogen chamber 182, longitudinal passages 202, the flow path 204 of multi-range metering cartridge 194, annular passage 208, equalizing chamber 210 and equalizing port 214.

The pressure relief valve 250 is designed to relieve pressure from the first flow passage means 236 to the second flow passage means 238 when the pressure differential therebetween exceeds the setting of relief valve 250.

The multi-range metering cartridge 194 and the various passages and components contained therein can generally be described as a retarding means disposed in the second pressure conducting passage means 238 for delaying communication of a sufficient portion of a change in well annulus pressure to the lower side 135 of actuating piston 136 for a sufficient amount of time to allow a pressure differential on the lower side 135 of actuating piston 136 to move the actuating piston 136 upwardly relative to housing 12. The retarding means also functions to maintain a sufficient portion of a change in well annulus pressure within the second pressure conducting passage and permit the differential in pressures between the first and second pressure conducting passages to balance.

The ball valve 70 can generally be referred to as an operating element 70 operably associated with the power piston 142 and actuating piston 136 for movement with the actuating piston 136 to a first closed position and with the power piston 142 to a second open position. It will be appreciated that with a rearrangement of the ball valve and its actuating mechanism, the tester valve 10 could be constructed to remain in its closed position during annulus pressure changes.

NORMAL OPERATION OF THE TESTER VALVE 10

In the normal mode the ball valve 70 is opened and closed by increasing and decreasing the annulus pressure between hydrostatic pressure and the first level above hydrostatic. Assuming that we begin with well annulus pressure at hydrostatic levels and a closed position of ball valve 70, the tester valve 10 is assembled for disposal into the wellbore such that load transfer shoulders 128 are aligned with load bearing shoulders 131. The operation of the tester valve 10 in its normal mode will be better understood from the following example. For exemplary purposes only, the first level of pressure above hydrostatic pressure is stated to be 1000 psi above hydrostatic, a sufficient change in annulus pressure from hydrostatic to move the ball valve 70 between its open and closed positions. Also by way of example, the second level of pressure above hydrostatic pressure is stated to be 2000 psi above hydrostatic. The pressure relief valve 250 is designed to be operable at a differential pressure somewhere between those first and second levels, for example, at a pressure differential in the range of 1200 to 1400 psi. When this differential pressure is applied across relief valve 250, it will open allowing hydraulic fluid to be metered slowly through fluid restrictor 248 from the oil power chamber 134 to the oil balancing chamber 174.

After the tester valve 10 has been set at the desired location within a well with the ball valve 70 in its closed position, a pressure increase will be imposed upon the well annulus so that the pressure exterior of the housing 12 is brought to the first level above hydrostatic. Fluid pressure will be transmitted into mud chamber 130 through power port 132 and along the first pressure conducting passage 236 to exert pressure upon actuating piston 136 to move actuating piston 136 downwardly. The fluid pressure is transmitted through the fluid within the oil power chamber 134 to the power piston 142 below. As the first level of pressure is applied to the power piston 142, it and operating mandrel assembly 92 are moved downwardly, thereby opening ball valve 70. The pressure increase within the first pressure conducting passage 236, following downward movement of the power piston 142, is stored with the nitrogen chambers 176 and 182 via compression of nitrogen gas contained within.

It is noted that an offsetting amount of fluid pressure is transmitted upward along the second pressure conducting passage 238 through equalization port 214 at the same time that it is transmitted downward along the first pressure conducting passage 236 through power port 132. The ball valve will still open, however, since the retarding means of the multi-range metering cartridge 194 will delay the increase in well annulus pressure from being communicated from the longitudinal passages 208 below to the longitudinal passages 202 above. As a result of the delay, the pressure within the first pressure conducting passage 236 will be greater than that within the second pressure conducting passage 238 during the delay and permits the ball valve 70 to open.

Once the well annulus pressure increase within the second pressure conducting passage 238 has been transmitted from longitudinal passages 208 to longitudinal passages 202 through metering cartridge 194, the first level of pressure will be stored within the nitrogen chambers 176 and 182 and the pressure differential between the first and second pressure conducting passages will become relatively balanced after a period of time.

If it is desired to close ball valve 70 in the normal mode of operation, the annulus pressure may be reduced to hydrostatic causing a reverse pressure differential within both the first and second pressure conducting passages 236 and 238 from the stored pressure within the nitrogen chambers 176 and 182. The metering cartridge 194 delays transmittal of the pressure differential downward within the second pressure conducting passage 238 from passages 202 to passages 208 thereby maintaining an increased level of pressure within the upper portions of the second pressure conducting passage 238. The pressure differential upward within first pressure conducting passage 236 urges actuating piston 136 upwardly at lower side 135. Through load transfer sleeve 126, ratchet sleeve 127 and shoulder 147, the upward motion is transmitted to the operating mandrel 96. The ball valve 70 is moved back to its closed position.

"LOCKING OPEN" THE TESTER VALVE 10

If desired, the tester valve 10 may be placed into a "locked open" position so that the ball valve 70 is retained in an open position during subsequent changes of well annulus pressure between hydrostatic and the first level above hydrostatic pressure by imposing upon the well annulus a second level of pressure which is above the first level and then reducing the pressure. The ability to lock the tool in this manner is useful if the operator desires to operate other annulus pressure responsive tools within the test string without changing the configuration of the tester valve 10. In the present example, the second level is 2,000 psi. Fluid pressure will once more be transmitted into mud chamber 130 through power port 132 and urge actuating piston 136 and power piston 142 downwardly to open the ball valve 70 as before. This pressure increase will be immediately felt at the upper side 141 of power piston 142 but will be delayed in metering through the fluid transfer assembly 151, so the power piston 142 and operating mandrel assembly 92 will rapidly move downward relative to housing 12 thus moving the ball valve 70 to an open position. During this initial movement, the actuating piston 136 will move downward an equivalent amount to accommodate the displacement of the power piston 142. With the well annulus pressure maintained at the 2,000 psi level, however, this pressure differential will then appear across relief valve 250 of power piston 142 which will open and which will allow fluid to be slowly metered through fluid restrictor 248 thus allowing the actuating piston 136 to move downward toward the power piston 142. As the actuating piston 136 and load transfer sleeve 126 are moved downwardly, the bearing 137 is moved from its first bearing stop position **133*a* to its second bearing stop position 133***b*. This movement causes the load transfer shoulders 128 to be brought out of engagement with the load bearing shoulders 131 by downward movement of the load transfer sleeve 126. Downward movement of actuating piston 136 and load transfer sleeve 126 is ultimately limited by shoulder 144.

Subsequently, when well annulus pressure is dropped back to hydrostatic pressure, pressure is reduced in mud chamber 130 and actuating piston 136 is permitted to move upwardly. The bearing 137 is moved from its second bearing stop position 133*b* to its third bearing stop position 133*c*. Although a pressure differential will be generated across power piston 142 with a greater pressure at the lower side 143 of power piston 142, upward movement of the power piston 142 is limited by shoulder 144. The pressure at the lower side 143 of power piston 142 is then reduced by unrestricted fluid flow upward through check valve 252 within fluid transfer assembly 151 of piston 142. Upward movement of actuating piston 136 is limited by contact with ported nipple 20. The pressure at the lower side 135 of actuating piston 136 will not be transmitted to the operating mandrel 96 because the load transfer shoulders 128 on load transfer sleeve 126 are not in engagement with the load bearing shoulders 131 of ratchet sleeve 127. The annulus pressure may, thus, be reduced without closing ball valve 70.

The well annulus pressure may be changed between hydrostatic and the first level any number of times. The load transfer sleeve 126 and bearing 137 will be moved between the third bearing stop position 133*c* and a location which is between the third bearing stop position 133*c* and fourth bearing stop position 133*d*. During these changes, the load transfer shoulders 128 will remain out of engagement with the load bearing shoulders 131.

Due to the operating pressure of the pressure relief valve 250 only being a few hundred psi above normal operating pressure, it may be that some of the operations which will be conducted while the ball valve 70 is locked open will slightly exceed the opening pressure of the pressure relief valve 250 and thus there may be small amounts of fluid which will meter downward during those operations. This will allow small movements of the actuating piston 136 which are accommodated by the normal separation between actuating piston 136 and power piston 142.

RETURNING TESTER VALVE 10 TO NORMAL MODE OF OPERATION

When it is desired to close the ball valve 70 and return the tester valve 10 to its normal mode of operation, the well annulus pressure is again increased to the second level of pressure which is above the first level. The actuating piston 136 and load transfer sleeve 126 are moved downwardly until the load transfer sleeve 126 contacts the shoulder 144. Bearing 137 is moved fully to its fourth bearing stop position 133*d*. At the second level of pressure, the pressure relief valve 250 of fluid transfer assembly 151 will again open to permit fluid flow through the-pressure relief valve 250 and fluid restrictor 248 within the power piston 142.

After a sufficient time interval to permit downward fluid flow through the power piston 142, the annulus pressure may be reduced once more to hydrostatic pressure to close the ball valve 70. Unrestricted upward fluid flow will occur once more through check valve 252 and an upward pressure differential will be generated at the lower side 135 of actuating piston 136 moving it upwardly with respect to housing 12. The bearing 137 is moved from its fourth bearing stop position 133*d* back to its first bearing stop position 133*a* and load transfer shoulders 128 are brought into engagement with the load bearing shoulders 131 by upward movement of the load transfer sleeve 126. As described previously, upward loading will cause the operating mandrel 92 to move upwardly thereby closing ball valve 70 and returning the tester valve 10 to its normal mode of operation.

METHODS OF OPERATION OF THE TESTER VALVE 10

The general methods of operating the tester valve 10 are as follows: As previously mentioned, the tester valve 10 is made up in a well test string including a number of other devices and the well test string is lowered into a well bore hole to a desired location. Then a packer of the test string is set against the well bore hole to seal the well annulus between the test string and the bore hole above the level of a subsurface formation which is to be tested. This isolates the well annulus above the packer from the well bore below the packer. Then pressure increases in the well annulus above the packer can be utilized to control the various tools of the well test string so as to selectively allow formation fluid from below the packer to flow up through the test string. The actual flow testing of the well is controlled by the flow tester valve 10 disclosed herein.

Although the flow tester valve 10 is shown in FIG. 1 in an initial position wherein it can be initially run into the well with the ball valve 70 open, it will be appreciated by those skilled in the art that another typical arrangement is to run the tester valve 10 into the well with the ball valve 70 in its closed position. This is accomplished simply by originally assembling the tester valve 10 so that the locking dogs 112 are engaged with groove 118 and so that the ball valve 70 is in its closed position with the actuating arm 92 moved upward relative to housing 12 so as to permit the locking dogs 112 to be received in the groove 118. In either case, the tester valve 10 should be initially configured such that the ratchet sleeve 127 and load transfer sleeve 126 contain the bearing 137 within the bearing slot grooving 133 at the first bearing stop position 133*a* and the load transfer shoulders 128 are engaged with the load bearing shoulders 131.

With the tester valve 10 in the position just described with the ball valve 70 closed, the well test string is run into the well to the desired location. Then the packer is set to seal the well annulus. Subsequently, the tester valve 10 may be operated in its normal mode or locked open and released as necessary being operated as described above. The ability to leave the ball valve 70 in the open position when well annulus pressure is decreased also allows the well test string to be pulled out of the well with the ball valve 70 open thus allowing the test string to drain as it is pulled from the well.

Thus it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts may be made by those skilled in the art, which changes are encompassed within the scope and spirit of the present invention as defined by the appended claims.

What is claimed is:

1. A selectively actuatable axial load transfer assembly operable to selectively transfer an axial load from a first tubular member to a second tubular member, said load transfer assembly comprising:

a. a first sleeve operably connectable to the first tubular member to receive an axial load therefrom, the first sleeve presenting a radial surface and a load transmitting member protruding therefrom;

b. a second sleeve operably connectable to the second tubular member to transmit an axial load thereto, the second sleeve presenting a radial surface complimentary to the radial surface of the first sleeve and a load bearing member protruding therefrom operable to engage the load transmitting member of the first sleeve;

c. the first and second sleeves constituting a motion translation assembly which, upon axial motion of the first tubular member causes one of said sleeves to selectively bring the load transmitting member into engagement with the load bearing member.

2. The selectively actuatable load transfer assembly of claim 1, wherein the motion translation assembly further comprises a bearing which dictates the operable association of the first and second sleeves by travelling within a bearing slot grooving within a radial surface of one of the sleeves.

3. The selectively actuatable load transfer assembly of claim 2, wherein said first tubular member is an actuating piston, said second tubular member is an operating mandrel, said first sleeve is a load transfer sleeve, said second sleeve is a ratchet sleeve, said load transmitting member is a load transmitting shoulder, and said load bearing member is a load bearing shoulder.

4. The selectively actuatable load transfer assembly of claim 1, wherein said second sleeve is a load transfer sleeve.

5. The selectively actuatable load transfer assembly of claim 1, wherein said first sleeve is a ratchet sleeve.

6. The selectively actuatable load transfer assembly of claim 1, wherein said load bearing member is a load bearing shoulder.

7. The selectively actuatable load transfer assembly of claim 1, wherein said load transmitting member is a load transmitting shoulder.

8. The selectively actuatable load transfer assembly of claim 1, wherein said first tubular member is an actuating piston.

9. The selectively actuatable load transfer assembly of claim 1, wherein said second tubular member is an operating mandrel.

* * * * *